US009062900B2

(12) United States Patent
Darke et al.

(10) Patent No.: US 9,062,900 B2
(45) Date of Patent: Jun. 23, 2015

(54) INTEGRATED EVAPORATOR AND ACCUMULATOR FOR REFRIGERANT SYSTEMS

(75) Inventors: Ranjit Darke, Los Angeles, CA (US); Peter Zheng, Rancho Palos Verdes, CA (US); Ricky Gov, El Monte, CA (US)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 284 days.

(21) Appl. No.: 12/941,189

(22) Filed: Nov. 8, 2010

(65) Prior Publication Data

US 2012/0111033 A1 May 10, 2012

(51) Int. Cl.

| | |
|---|---|
| ***F25D 17/06*** | (2006.01) |
| ***F25B 43/00*** | (2006.01) |
| ***F25B 43/02*** | (2006.01) |
| ***F25B 39/02*** | (2006.01) |

(52) U.S. Cl.

CPC ..... *F25B 39/022* (2013.01); *F25B 43/006* (2013.01)

(58) Field of Classification Search

CPC ..... F25B 43/00; F25B 43/006; F25B 43/02; F25B 2400/02; F25B 2500/16; F25B 31/002
USPC ..... 62/84, 468, 470, 471, 503
See application file for complete search history.

(56) References Cited

U.S. PATENT DOCUMENTS

| | | | | |
|---|---|---|---|---|
| 3,163,998 | A * | 1/1965 | Wile et al. | 62/278 |
| 4,679,410 | A | 7/1987 | Drayer | |
| 4,745,778 | A | 5/1988 | Carella | |
| 4,794,765 | A * | 1/1989 | Carella et al. | 62/512 |
| 5,172,758 | A * | 12/1992 | Aoki | 165/110 |
| 5,308,264 | A | 5/1994 | Perretta et al. | |
| 5,505,060 | A | 4/1996 | Kozinski | |
| 6,516,627 | B2 * | 2/2003 | Ring et al. | 62/471 |
| 6,557,371 | B1 * | 5/2003 | Judge | 62/468 |
| 7,694,528 | B2 * | 4/2010 | Nishida et al. | 62/500 |
| 2002/0076978 | A1 | 6/2002 | Meyer et al. | |
| 2004/0031596 | A1 | 2/2004 | Nishida et al. | |
| 2008/0127666 | A1 * | 6/2008 | Major et al. | 62/244 |
| 2011/0056664 | A1 * | 3/2011 | De Larminat et al. | 165/160 |

FOREIGN PATENT DOCUMENTS

| | | | |
|---|---|---|---|
| EP | 1365485 | A1 | 11/2003 |
| EP | 1923965 | A1 | 5/2008 |
| EP | 1422085 | B2 | 12/2008 |

(Continued)

OTHER PUBLICATIONS

US 6,408,642, 6/2002, Judge (withdrawn).

(Continued)

*Primary Examiner* — Cheryl J Tyler
*Assistant Examiner* — Elizabeth Martin
(74) *Attorney, Agent, or Firm* — Shimokaji IP

(57) ABSTRACT

A space-saving cooling system for an aircraft may include an evaporator in an enclosure with an accumulation region in the enclosure for a liquid mixture of liquid refrigerant and lubricating oil. Space saving may be achieved through a combining of evaporator functions and accumulator functions in a single enclosure. A heat exchanger may be interposed between the evaporator and the compressor for heating refrigerant emerging from the evaporator so that liquid refrigerant does not reach an inlet of the compressor.

12 Claims, 7 Drawing Sheets

(56) References Cited

FOREIGN PATENT DOCUMENTS

| | | | |
|---|---|---|---|
| JP | 55 013350 | U | 1/1980 |
| JP | 3087572 | A | 4/1991 |
| WO | WO 9609512 | A1 | 3/1996 |
| WO | WO 2006 101569 | A2 | 9/2006 |
| WO | WO 2006 101569 | A3 | 9/2006 |
| WO | 2007046788 | A2 | 4/2007 |

OTHER PUBLICATIONS

Chinese Office Action in CN Application No. 201110461903.6 dated Jan. 12, 2015.

* cited by examiner

INTEGRATED EVAPORATOR AND ACCUMULATOR FOR REFRIGERANT SYSTEMS

BACKGROUND OF THE INVENTION

The present invention generally relates to refrigeration systems. More particularly, the invention relates to a compact refrigeration system which may be advantageous employed in a vehicle.

In some vehicles such as aircraft, refrigeration systems may be employed to perform various cooling functions. In a typical aircraft, where space is limited, it is advantageous to construct on-board refrigeration systems that occupy as little volume as possible. At the same time, it is advantageous to construct aircraft refrigeration systems with low weight and high efficiency.

It is known that incorporating an accumulator for liquid refrigerant in a system may improve its efficiency and longevity. An accumulator may preclude liquid slugging, a common problem that can damage compressors. Liquid refrigerant dilutes oil and reduces the viscosity of the oil-refrigerant mixture. Reduced viscosity tends to affect the life of compressors and may result in damage. Secondly, liquid at the compressor inlet may cause excessive pressures in fixed displacement designs.

While accumulators are desirable features for refrigeration systems, their use has heretofore added substantial volume to a refrigeration system. Typically, an effective accumulator must have a volume that is about equal to volume of an evaporator of the system.

As can be seen, there is a need for an aircraft refrigeration system in which an accumulator function may be employed and in which the accumulator function adds only minimal volume to the system.

SUMMARY OF THE INVENTION

In one aspect of the present invention, a space-saving cooling system for an aircraft comprising: an evaporator in an enclosure, the enclosure including an accumulation region capable of holding a liquid mixture of liquid refrigerant and lubricating oil; and a heat exchanger interposed between the evaporator and a compressor for heating refrigerant emerging from the evaporator so that liquid refrigerant does not reach an inlet of the compressor.

In another aspect of the present invention, an evaporator may comprise: an enclosure with an outlet; at least one refrigerant passage within the enclosure; an impingement surface within the enclosure; a vapor flow region interposed between an outlet end of the refrigerant passage and the impingement surface; a liquid accumulation region at a lower end of the impingement surface; and a metering orifice adjacent the accumulation region; the liquid accumulation region in communication with the outlet through the metering orifice; and an upper end of the impingement surface being in direct communication with the outlet.

In still another aspect of the present invention, a method for performing refrigeration cooling in a constrained space may comprise the steps of: evaporating refrigerant in an evaporator contained in an enclosure; accumulating liquid refrigerant in the same enclosure; and releasing metered quantities of the liquid refrigerant from the enclosure to a compressor at a rate that does not produce liquid slugging of a compressor.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

The present invention generally provides a cooling system that uses a space-saving evaporator that performs both evaporation and accumulator functions in the same enclosure.

Figure 1:
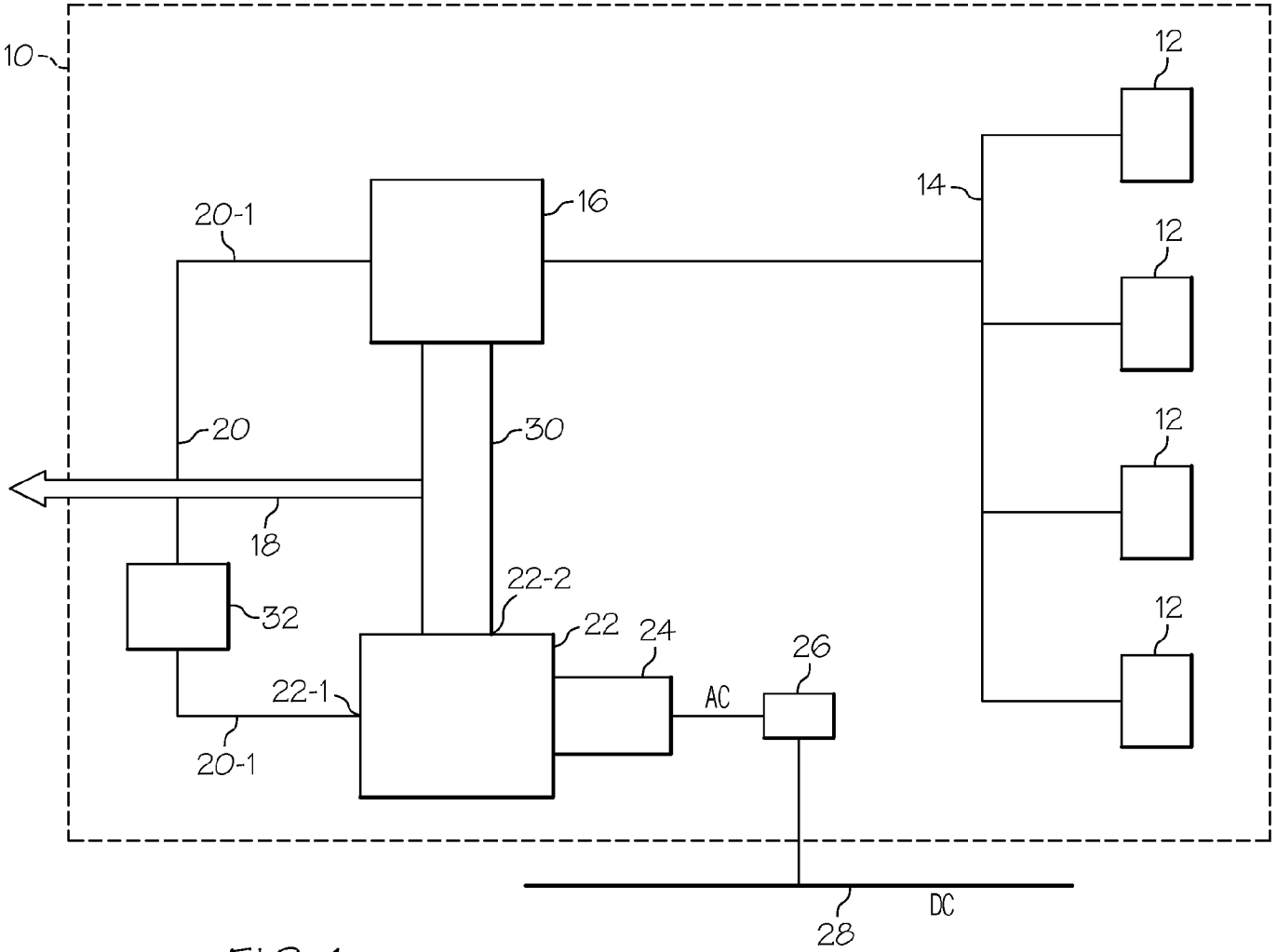
FIG. 1 is a block diagram of a distributed cooling system in accordance with an embodiment of the invention.

Referring now to FIG. 1, a distributed cooling system 10 is shown in block diagram format. In an exemplary embodiment of the invention, the system 10 may comprises a plurality of cooled storage boxes 12 which may be used for storing food and beverage on a commercial aircraft (not shown). In the system 10, heat from the boxes 12 may be extracted through a fluid-filled cooling circuit 14 and conveyed to an evaporator 16. The evaporator 16 may extract heat from the cooling circuit 14. Extracted heat from the storage boxes 12 may be exhausted from the aircraft through a heated-air discharge 18.

A refrigerant circuit 20 may interconnect the evaporator 16 to a compressor 22 at an inlet side 22-1 through a suction line 20-1 that may pass through a heat exchanger 32. In an exemplary embodiment of the invention, the compressor 22 may be a scroll compressor. The compressor 22 may be driven by an AC motor 24 which may be provided with electrical power through a dedicated inverter 26 which may be connected to a DC bus 28 of the aircraft. The compressor 22 may be interconnected, at an outlet side 22-2, to the evaporator 16 through a condenser 30.

Figure 2:
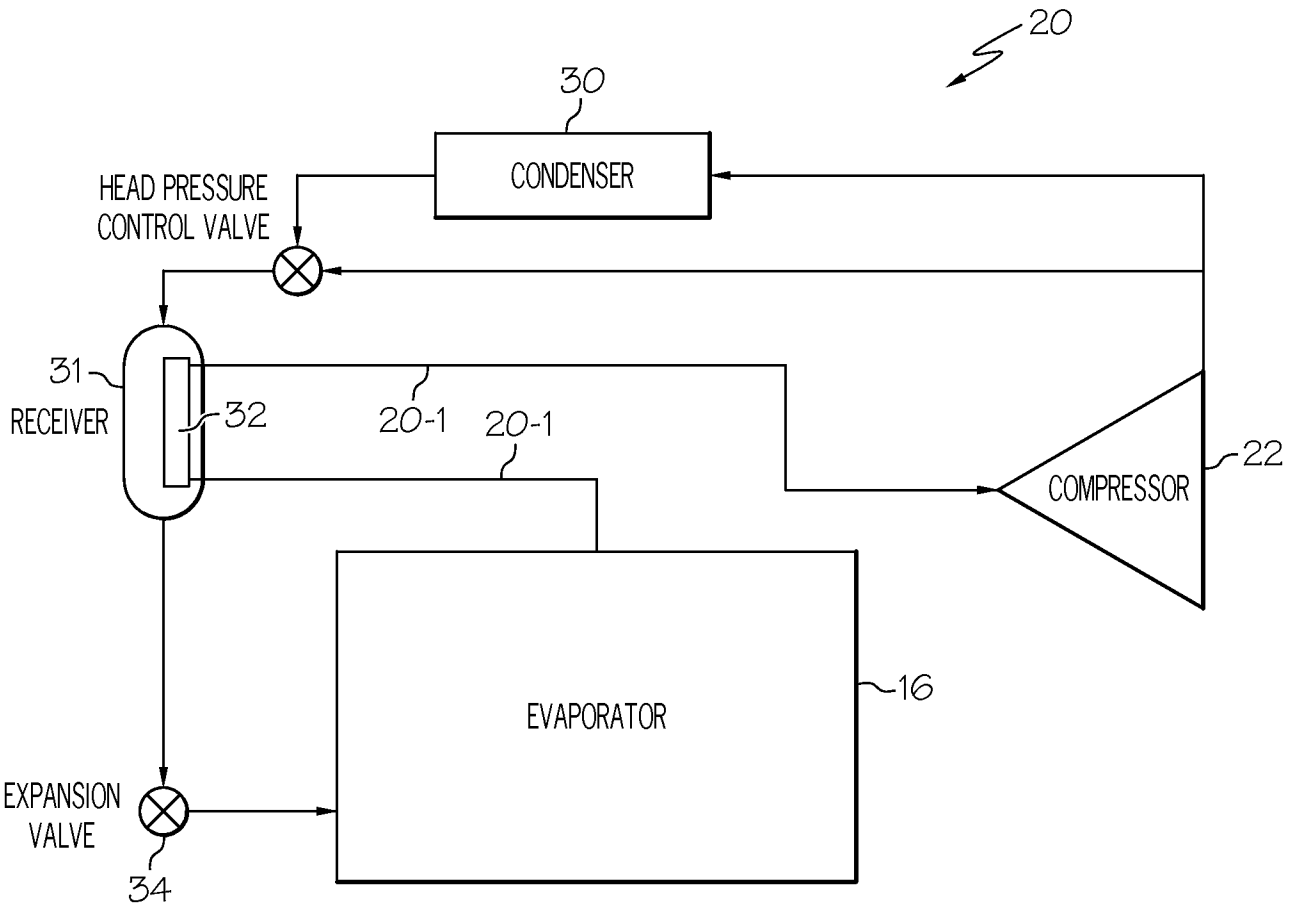
FIG. 2 is schematic diagram of a refrigeration system that may be employed in the cooling system of FIG. 1 in accordance with an embodiment of the invention.

Referring now to FIG. 2, a schematic diagram of an exemplary embodiment of the refrigerant circuit 20 is illustrated. The circuit 20 may interconnect the compressor 22, the condenser 30, a receiver 31, an expansion valve 34 and the evaporator 16. In the exemplary embodiment of FIG. 2, the evaporator 16 may be provided with capability for acting as an accumulator for liquid refrigerant and lubricating oil.

Figure 3:
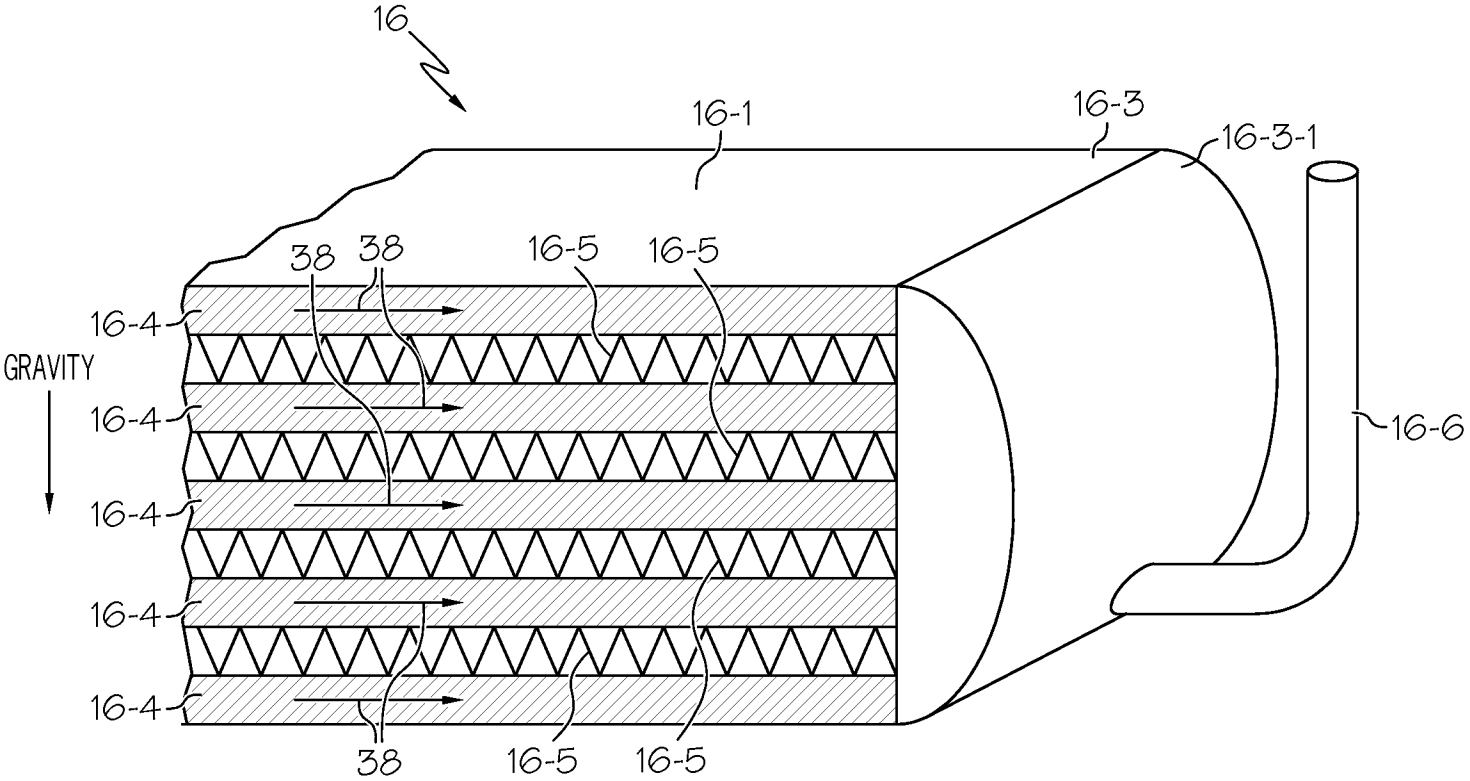
FIG. 3 is a partial cross-sectional view of a first embodiment of an evaporator in accordance with the invention.
Figure 4A:
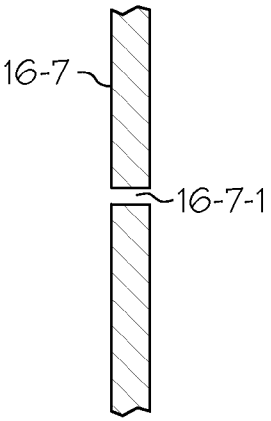
FIG. 4 is a detailed cross-sectional view of the evaporator of FIG. 4 in accordance with an embodiment of the invention.
Figure 4:
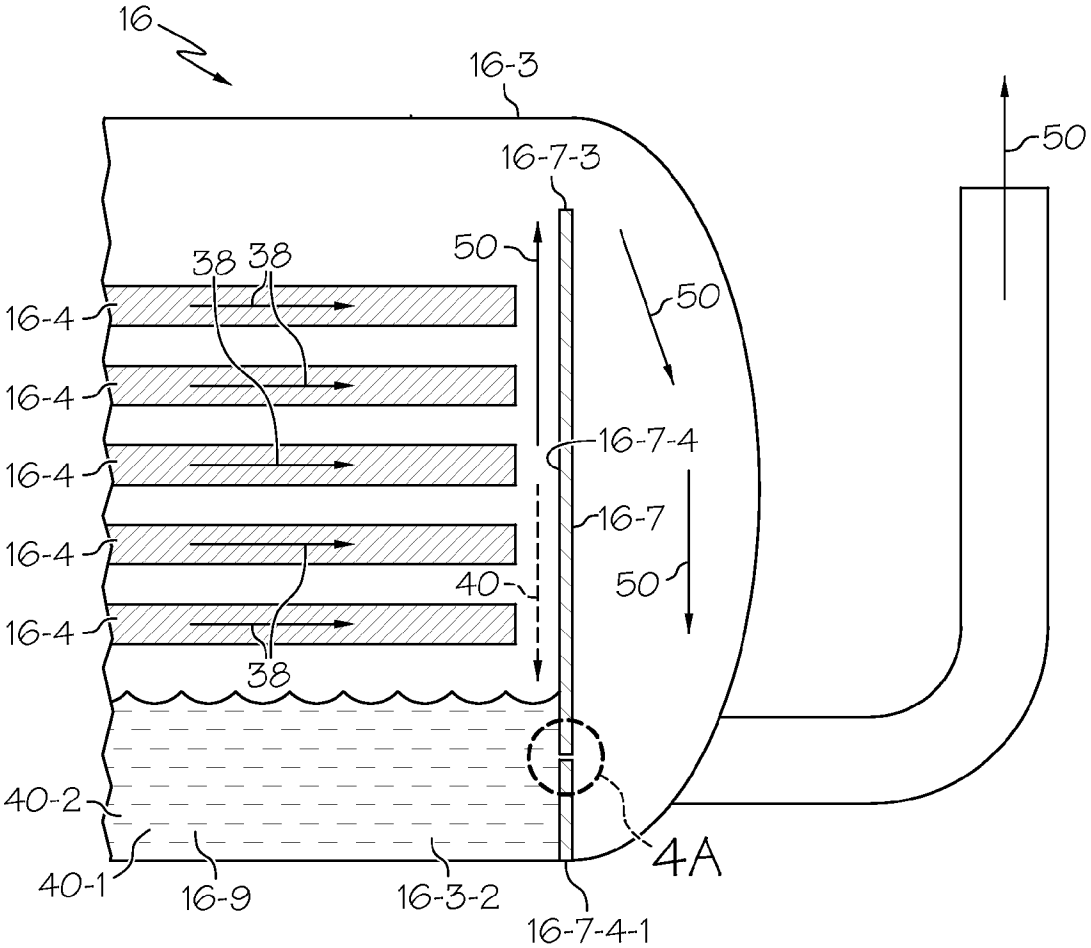

Referring now to FIGS. 3 and 4 it may be seen that the evaporator 16 may be constructed so that evaporator functions and accumulator functions may be contained in the same enclosure 16-3. In other words, both evaporator functions and accumulator functions may be performed, in a space-saving arrangement, in a single volume that may substantially equal to a volume that would be typically employed only for evaporator functions. Such a space-saving arrangement may be particularly advantageous when the cooling system 10 may be installed in an aircraft or other aerospace vehicle.

The evaporator 16 may comprise the enclosure 16-3, refrigerant passages 16-4 and cooling fluid passages 16-5. The passages 16-4 may be used to convey refrigerant 38 through the evaporator 16 as the refrigerant changes state from liquid to vapor. When installed in an operational mode the refrigerant passages 16-4 may be oriented orthogonally to a direction of gravity. The enclosure 16-3 may be provided with an end cap 16-3-1. An outlet tube 16-6 may be attached to the end cap 16-3-1.

In FIG. 4, it may be seen that refrigerant vapor, indicated by flow lines 50, may pass through the refrigerant passages 16-4 into a vapor flow region 16-8 and through the outlet tube 16-6 into the suction line 20-1 for the compressor 22 (See FIG. 2). The refrigerant 38 entering the refrigerant passage 16-4 may be comingled with lubricating oil. As the refrigerant 38 passes through the evaporator 16, some or all of the refrigerant 38 may vaporize. Under some operating conditions some of the refrigerant 38 may emerge from the refrigerant passages in a liquid state. It may be advantageous to separate liquid refrigerant and lubricating oil from refrigerant vapor in the evaporator 16.

The evaporator 16 may be provided with a baffle 16-7 that may extend from a bottom 16-3-2 of the enclosure 16-3 and may positioned orthogonally to the refrigerant passages 16-4. As the refrigerant 38 impinges against the baffle 16-7, refrigerant vapor 50 may pass over a top 16-7-3 of the baffle 16-7 and then into a vapor flow region 16-8. The refrigerant vapor 50 may then flow into the outlet tube 16-6. A mixture of lubricating oil 40-1 and liquid refrigerant 40-2, indicated collectively by the numeral 40, may impinge against an impingement surface 16-7-4 of the baffle 16-7 and then flow downwardly to a liquid accumulation region 16-9 at a bottom 16-7-4-1 of the impingement surface 16-7-4. The baffle 16-7 may be provided with an orifice 16-7-1 through which the liquid 40 may flow.

It may be seen that the liquid 40 may accumulate in the liquid accumulation region 16-9 whenever there may be fluid 40 emerging from the refrigerant passages 16-4 at a rate higher than a flow rate through the orifice 16-7-1. Accumulated fluid 40 may be released through the orifice 16-7-1 at a controlled or metered rate, which rate may be a function of the diameter of the orifice. This may be particularly advantageous during certain transient operational modes of the cooling system 10. For example, during start-up, a significant portion of the refrigerant 38 may emerge from the refrigerant passages 16-4 as liquid refrigerant 40-2. In such a case, the baffle 16-7 may preclude rapid entry of the refrigerant liquid 40-2 into the compressor 22. During steady-state operation of the system 10, most of the refrigerant 38 may emerge from the refrigerant passages 16-4 as vapor 50. Under these steady-state operating conditions, most of the liquid 40 emerging from the refrigerant passages may be lubricating oil 40-1. The orifice 16-7-1 may be sized to allow fluid flow at a rate about equivalent to a rate at which the lubricating oil 40-1 emerges from the refrigerant passages 16-4 under steady-state operating conditions. Any liquid refrigerant 40-2 that may be accumulated in the liquid accumulation region 16-9 may be comingled with lubricating oil 40-1. The liquid 40 may be metered out through the orifice 16-7-1 at a rate that may allow for subsequent evaporation of the liquid refrigerant 40-2 in the suction line 20-1 of the compressor 22. Thus the compressor 22 may be provided with a proper amount of lubricating while not suffering from liquid slugging.

Figure 5:
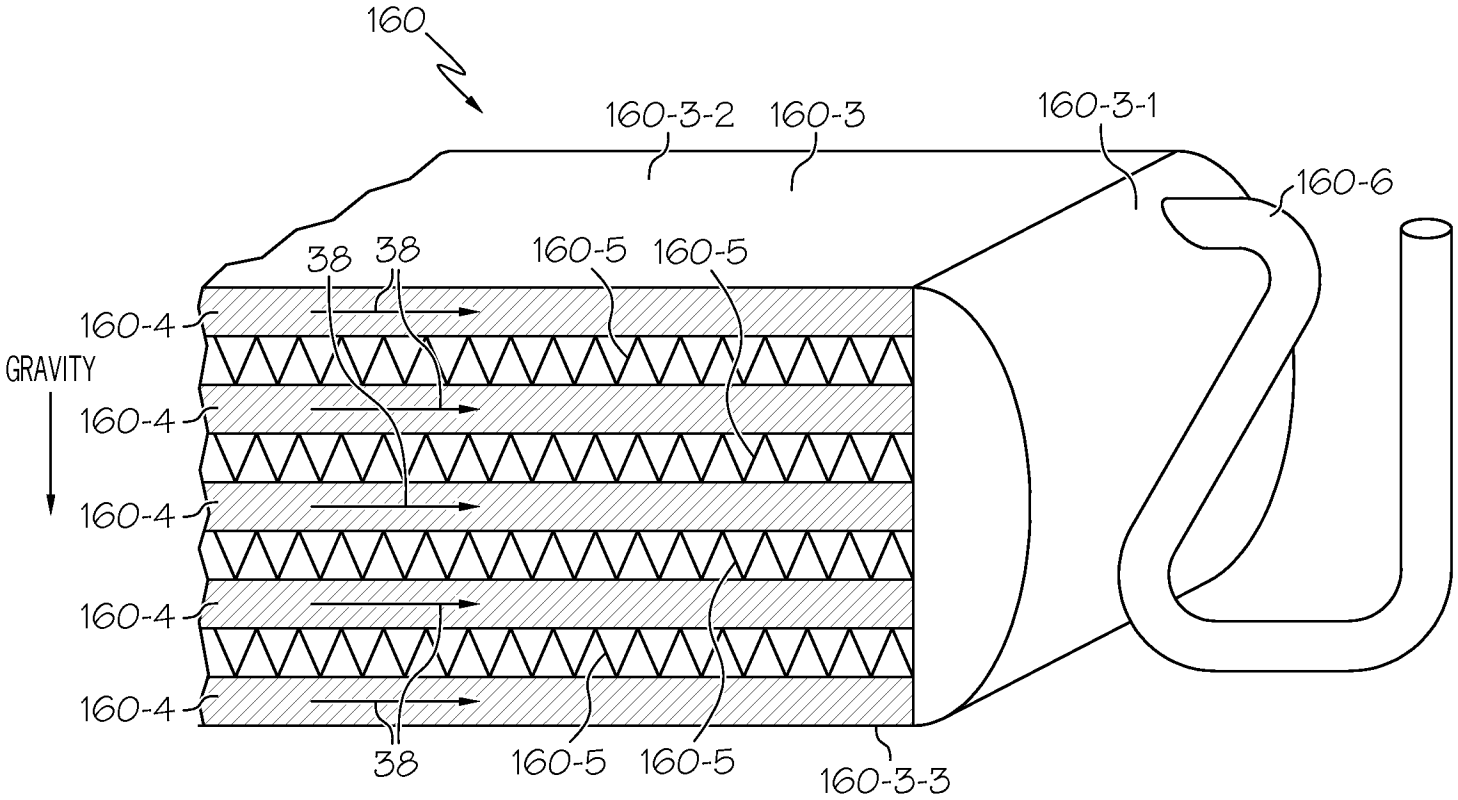
FIG. 5 is a partial cross-sectional view of a second embodiment of an evaporator in accordance with the invention.
Figure 6A:
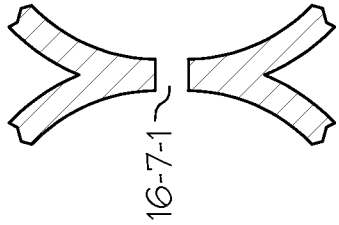
FIG. 6 is a detailed cross-sectional view of the evaporator of FIG. 5 in accordance with an embodiment of the invention.
Figure 6:
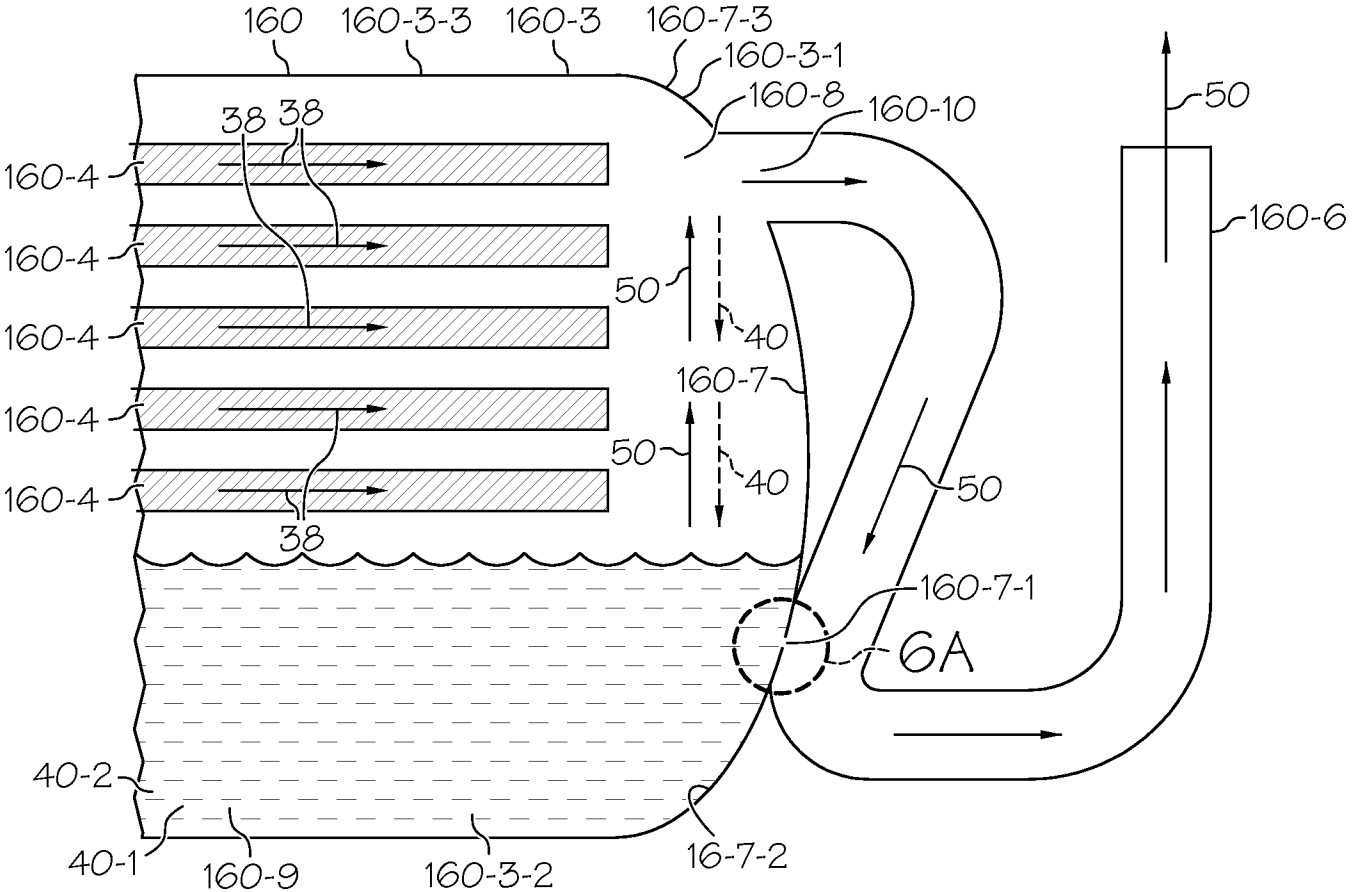

Referring now to FIGS. 5 and 6, an exemplary embodiment an inventive evaporator 160 may be seen. The evaporator 160 may be constructed so that an evaporator function and an accumulator function may be contained in the same enclosure. In other words, both an evaporator and an accumulator may, in a space-saving arrangement, occupy a single volume that is substantially equal to a volume that would be typically employed only for an evaporator. Such a space-saving arrangement may be particularly advantageous when the cooling system 10 may be installed in an aircraft or other aerospace vehicle.

The evaporator 160 may comprise an enclosure 160-3, refrigerant passages 160-4 and cooling fluid passages 160-5. When installed in an operational mode the refrigerant passages 160-4 may be oriented orthogonally to a direction of gravity. The enclosure 160-3 may be provided with an end cap 160-3-1. An outlet tube 160-6 may be attached to the end cap 160-3-1.

In FIG. 6, it may be seen that the refrigerant vapor 50, may pass into the end cap 160-3-1 and through the outlet tube 160-6 into the suction line 20-1 for the compressor 22 (see FIG. 2). The refrigerant 38 entering the refrigerant passages 16-4 may be comingled with the lubricating oil 40-1. As refrigerant 38 passes through the evaporator 160, some or all of the refrigerant 38 may vaporized. Under some operating conditions some of the refrigerant 38 may emerge from the refrigerant passages as liquid refrigerant 40-2. It may be advantageous to separate the liquid refrigerant 40-2 and lubricating oil 40-1 from refrigerant vapor 50 in the evaporator 160. As refrigerant 38 impinges against an impingement surface 160-7 on the end cap 160-3-1, refrigerant vapor 50 may pass upwardly in a vapor flow region 160-8 and into the outlet tube 160-6. Lubricating oil 40-1 and liquid refrigerant 40-2, indicated collectively by the numeral 40, may impinge against the impingement surface 160-7 and then flow downwardly to a liquid accumulation region 160-9 at a bottom 160-3-2 of the evaporator enclosure 160-3. The outlet tube 160-6 may be joined to the end cap 160-3-1 at two locations; an outlet port 160-10; and at an orifice 160-7-1.

It may be seen that the liquid 40 may accumulate in the liquid accumulation region 160-9 whenever there may be fluid 40 emerging from the refrigerant passage 160-4 at a rate higher than a flow rate through the orifice 160-8. Accumulated fluid 40 may be released through the orifice 160-7-1 at a controlled or metered rate, which rate may be a function of the diameter of the orifice. This may be particularly advantageous during certain transient operational modes of the cooling system 10. For example, during start-up, a significant portion of the refrigerant flow through the evaporator 160 may emerge as liquid refrigerant 40-2. In such a case, the end cap 160-3-1 may preclude rapid entry of liquid refrigerant 40-2 into the compressor 22. During steady-state operation of the system 10, most of the refrigerant 38 may emerge from the refrigerant passages 160-4 as vapor 50. Under these steady-state operating conditions, most of the liquid 40 emerging from the refrigerant passages may be lubricating oil 40-1. The orifice 160-8 may be sized to allow fluid flow at a rate about equivalent to a rate at which the lubricating oil 40-1 may emerge from the refrigerant passages 160-4 under steady-state operating conditions. Any liquid refrigerant 40-2 that may be accumulated in the liquid accumulation region 160-9 may be comingled with lubricating oil 40-1. The liquid 40 may be metered out through the orifice 160-8 at a rate that may allow for subsequent evaporation of liquid refrigerant 40-2 in the suction line 20-1. Thus, the compressor 22 may be provided with a proper amount of lubrication while not suffering from liquid slugging.

Figure 7:
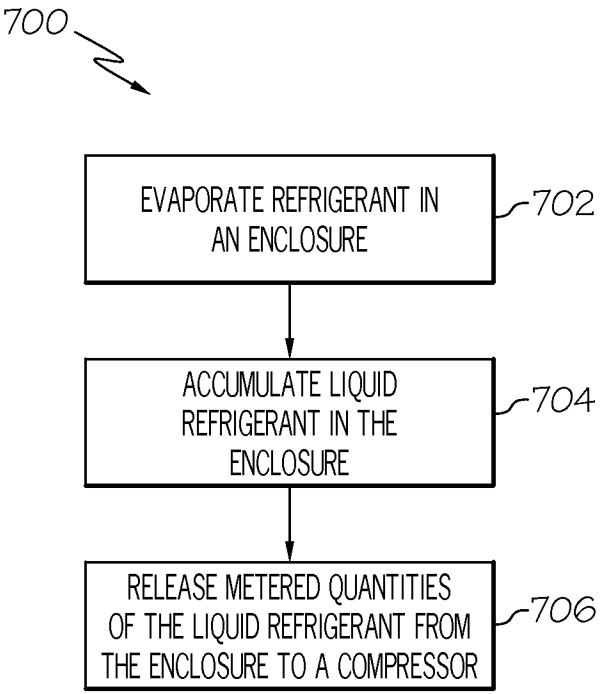
FIG. 7 is a flow chart of a method for performing refrigeration cooling in a constrained space in accordance with an embodiment of the invention.

Referring now to FIG. 7, an exemplary method 700 may be employed to perform refrigeration cooling in a constrained space. In a step 702, a refrigerant may be evaporated in an evaporator contained in an enclosure (e.g., the refrigerant 38 may be passed though the refrigerant passages 16-4 in the enclosure 16-3 and heated with heat transfer from fluid in the cooling fluid passages 16-5). In a step 704, liquid refrigerant may be accumulated in the same enclosure (e.g., the refrigerant 38 may be released onto the impingement surface 16-7-4 in the enclosure 16-3 so that the refrigerant 38 impinges on the surface and a downward flow of the liquid refrigerant 40-2 may take place into the accumulation region 16-9 of the enclosure 16-3). In a step 706, metered quantities of the liquid refrigerant may be released from the enclosure to a compressor at a rate that does not produce liquid slugging of a compressor (e.g., the fluid mixture 40 may be allowed to pass through the orifice 16-7-11).

It should be understood, of course, that the foregoing relates to exemplary embodiments of the invention and that modifications may be made without departing from the spirit and scope of the invention as set forth in the following claims.

We claim:

1. A space-saving cooling system for an aircraft comprising:

an evaporator including:

a refrigerant passage that extends in a substantially horizontal direction that is substantially orthogonal to a direction of gravity, a wall that extends in a substantially vertical direction that is substantially orthogonal to the horizontal direction, wherein the wall interfaces the refrigerant passage, an accumulation region located at a position along the vertical direction and that is directly underneath the refrigerant passage, wherein the accumulation region is configured to hold a mixture of liquid refrigerant and lubricating oil;

a metering orifice in the wall, wherein the orifice is located at a position along the vertical direction and that is within a height along the vertical direction of the accumulation region;

an outlet for the mixture, wherein the outlet is located at a position along the vertical direction and that is within the height of the accumulation region, wherein the position of the orifice and the position of the outlet along the vertical direction are substantially the same; and a heat exchanger downstream of the evaporator; and a compressor downstream of the heat exchanger.

2. The cooling system of claim 1, wherein the wall is a baffle.

3. An evaporator comprising;

an enclosure with an outlet tube;

a refrigerant passage within the enclosure configured to vaporize a refrigerant, wherein the refrigerant passage is located along a vertical direction that is substantially parallel to a direction of gravity;

an impingement surface within the enclosure, wherein the impingement surface is disposed to contact the vaporized refrigerant from the refrigerant passage;

a vapor flow region adjacent an outlet end of the enclosure;

a liquid accumulation region located at a position along the vertical direction and that is directly underneath the position of the refrigerant passage along the vertical direction;

a metering orifice in the impingement surface, wherein the orifice is located at a position along the vertical direction and that is within a height along the vertical direction of the accumulation region, wherein the position of the orifice along the vertical direction is within a height of the outlet tube along the vertical direction; and the liquid accumulation region being in communication with the outlet tube through the metering orifice.

4. The evaporator of claim 3 wherein the impingement surface comprises a baffle.

5. The evaporator of claim 4 wherein the metering orifice comprises a hole in the baffle.

6. The evaporator of claim 4:

wherein a lower end of the impingement surface is attached to a bottom of the enclosure; and wherein an upper end of the impingement surface is spaced away from a top of the enclosure so that refrigerant vapor can flow freely over an upper end of the baffle.

7. The evaporator of claim 4, wherein the outlet tube comprises a tube attached to the enclosure in alignment with the liquid accumulation region.

8. A method for performing refrigeration cooling in a constrained space with an enclosure having an evaporator and an impingement surface, the method comprising the steps of:

evaporating refrigerant in a refrigerant passage of the evaporator contained in the enclosure to obtain vaporized refrigerant;

using the impingement surface with an upper end and a lower end within the enclosure to separate liquid refrigerant and lubricating oil from vaporized refrigerant, wherein the impingement surface is positioned along a vertical direction that is substantially parallel to a direction of gravity, wherein said lower end has a metering orifice, and wherein the impingement surface is positioned orthogonally to a passage axis of the refrigerant passage;

flowing the vaporized refrigerant flow around the upper end of the impingement surface;

accumulating separated liquid refrigerant and lubricating oil in an accumulation region, wherein the accumulation region is located at a position along the vertical direction that is directly under the refrigerant passage in the evaporator;

passing metered quantities of the liquid refrigerant through said metering orifice to an outlet of the enclosure at a rate that evaporates a portion of the separated liquid refrigerant from the lubricating oil prior to entering a compressor, the outlet being positioned across from the impingement surface, and wherein the outlet is in alignment, along a horizontal direction, with the accumulation region, wherein the horizontal direction is substantially orthogonal to the vertical direction; and releasing the metered quantities of the liquid refrigerant from the outlet of the enclosure to the compressor.

9. The method of claim 8, where in the step of accumulating separated liquid refrigerant and lubricating oil comprises:

permitting a downward flow of the liquid refrigerant into the accumulation region underneath the refrigerant passage.

10. The method of claim 9 further comprising the step of permitting upward flow of refrigerant vapor over the impingement surface to the outlet of the enclosure.

11. The method of claim 8, further comprising heating the released liquid refrigerant to vaporize it prior to allowing the liquid refrigerant to reach the compressor.

12. The method of claim 8, wherein the step of releasing metered quantities of liquid refrigerant comprises releasing the lubricating oil along with the liquid refrigerant at a rate of release that provides lubrication of the compressor with the lubricating oil without slugging.

* * * * *